US006165664A

United States Patent [19]

Kobayashi et al.

[11] Patent Number: 6,165,664

[45] Date of Patent: Dec. 26, 2000

[54] TWO-COMPONENT DEVELOPING AGENT AND IMAGE FORMING METHOD USING SUCH A DEVELOPING AGENT

[75] Inventors: Makoto Kobayashi, Kobe; Tomoharu Nishikawa, Hirakata; Hideaki Yasunaga, Nishinomiya; Koichi Takenaka, Itami, all of Japan

[73] Assignee: Minolta Co., Ltd., Osaka, Japan

[21] Appl. No.: 09/323,270

[22] Filed: Jun. 1, 1999

[30] Foreign Application Priority Data

Jun. 2, 1998 [JP] Japan ..... 10-152817

[51] Int. Cl.[7] ..... G03G 9/10

[52] U.S. Cl. ..... 430/108; 430/111

[58] Field of Search ..... 430/108, 109, 430/106, 110, 111

[56] References Cited

U.S. PATENT DOCUMENTS 4,996,126 2/1991 Anno et al. ..... 430/106.6
5,419,994 5/1995 Honjo et al. ..... 430/106.6
5,534,981 7/1996 Ohno et al. ..... 430/109
5,689,781 11/1997 Shibano et al. ..... 399/252
5,763,229 9/1998 Kobayashi et al. ..... 430/106.6
5,834,152 11/1998 Yasunaga et al. ..... 430/108

*Primary Examiner*—John Goodrow
*Attorney, Agent, or Firm*—McDermott, Will & Emery

[57] ABSTRACT

A two-component developing agent which is made from at least a carrier and a toner, characterized in that bulk specific density ($AD_1$) of the carrier is set at 1.07 to 1.43 g/cc, bulk specific density ($AD_2$) of the developing agent is set at 0.83 to 1.16 g/cc and $AD_2/AD_1$ is set at 0.69 to 0.91. The present invention includes an image-forming method and an image-forming system, in which the above two-component developing agent is used.

20 Claims, 2 Drawing Sheets

TWO-COMPONENT DEVELOPING AGENT AND IMAGE FORMING METHOD USING SUCH A DEVELOPING AGENT

This application is based on application(s) No. Japanese Patent Application No. Hei 10-152817 filed in Japan, the contents of which are hereby incorporated by reference.

BACKGROUND OF THE INVENTION

1. Field of the Invention

The present invention relates to a two-component developing agent in an image-forming apparatus such as a digital copying machine and a printer.

2. Description of the Related Art

In copying machines or printers of the electrophotographic system, a two-component developing agent composed of a toner and a carrier has been commonly used for developing an electrostatic latent image formed on an image-supporting member such as a photosensitive member. The two-component developing agent is used in a two-component developing system. In this system, the toner is frictionally charged by the carrier while the developing agent is being stirred, and the charged toner is used in a developing process.

With respect to carriers used for the two-component developing agent, various carriers, such as iron power carrier, ferrite carrier, resin-coated carrier in which these magnetic particles are coated with resin, and binder carrier in which magnetic fine particles are dispersed in binder resin, have been known.

However, the problem with the conventional two-component developing agent is that as the developing agent is used for a long time, fog tends to occur in copied images, the image density tends to decrease, and unevenness (density unevenness) tend to occur in images.

SUMMARY OF THE INVENTION

The present invention is to provide a two-component developing agent which can prevent the occurrence of fog and image irregularity as well as reduction in the image density for a long time.

Another objective of the present invention is to provide an image-forming method which can prevent the occurrence of fog and image irregularity and reduction in the image density for a long time.

The object of the present invention can be achieved by composing a two-component developing agent comprising:

a toner; and a carrier having a bulk specific density ($AD_1$) of 1.07 to 1.43 g/cc, wherein said developing agent has a bulk specific density ($AD_2$) of 0.83 to 1.16 g/cc and $AD_2/AD_1$ is in a range of 0.69 to 0.91.

DETAILED DESCRIPTION OF THE INVENTION

Figure 1:
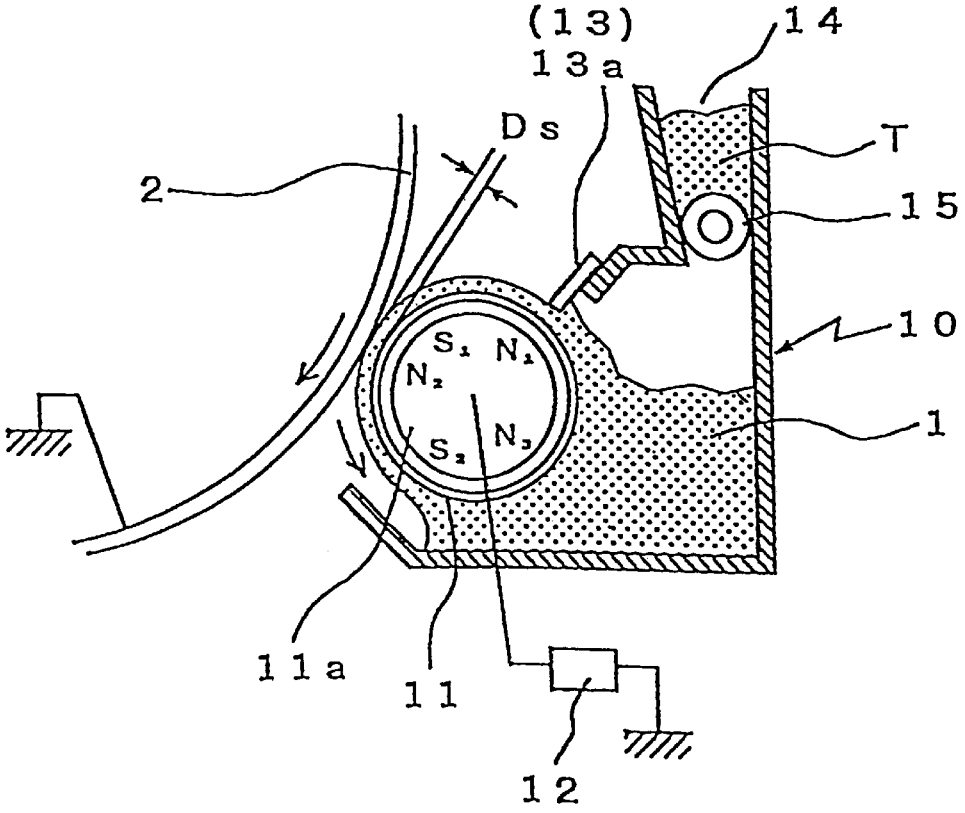
FIG. 1 is a schematic view showing the structure of a developing machine of two-component developing system.

The present invention relates to a two-component developing agent comprising:

a toner; and a carrier having a bulk specific density ($AD_1$) of 1.07 to 1.43 g/cc, wherein said developing agent has a bulk specific density ($AD_2$) of 0.83 to 1.16 g/cc and $AD_2/AD_1$ is in a range of 0.69 to 0.91.

The present invention also relates to an image-forming method in which the above-mentioned developing agent is used.

The present invention is characterized in that the attention is made on the relationship between the bulk specific density ($AD_1$) of the carrier and the bulk specific density ($AD_2$) of the developing agent and that the values of these factors and the value of $AD_2/AD_1$ are controlled in a regulated range.

The two-component developing agent of the present invention comprises at least a carrier and a toner.

A bulk specific density ($AD_1$) of the carrier contained in the developing agent of the present invention is set in the range of 1.07 to 1.43 g/cc, preferably 1.10 to 1.40 g/cc, and more preferably 1.15 to 1.35 g/cc. If $AD_1$ is less than 1.07 g/cc, the carrier fluidity deteriorates, failing to uniformly mix the carrier with the toner and causing image irregularity (density unequality). In contrast, $AD_1$ exceeding 1.43 g/cc causes insufficient friction between the carrier and the toner and a subsequent insufficient charge of toner, resulting in fog in the images. By setting $AD_1$ in the above-mentioned range, the present invention makes it possible to improve the electrification-build-up properties of toner and also to uniformly mix the toner and the carrier. Thus, it becomes possible to prevent the occurrence of fog and image irregularity (density unevenness).

The bulk specific density ($AD_2$) of the developing agent of the present invention is set in the range of 0.83 to 1.16 g/cc, preferably 0.85 to 1.15 g/cc, and more preferably 0.90 to 1.10 g/cc. If $AD_2$ is less than 0.83 g/cc, the amount of carriage on the sleeve becomes unstable, causing density unevenness and reduction in the image density. $AD_2$ exceeding 1.16 g/cc makes the bulk specific density susceptible to fluctuation upon printing, resulting in reduction in the image density. By setting $AD_2$ in the above-mentioned range, the present invention makes it possible to maintain a constant amount of developing agent carriage on the sleeve, preventing the occurrence of density unevenness and reduction in the image density. Here, the developing agent refers to a mixture of a carrier with a toner; and when an externally additive agent such as a fluidizing agent is added to the toner, the developing agent means a mixture which further contains such an externally additive agent.

In the developing agent of the present invention, $AD_2/AD_1$ is set in the range of 0.69 to 0.91, preferably 0.70 to 0.90, more preferably, 0.75 to 0.85. If the ratio is less than 0.69, the toner density in the developing agent becomes too high, or the bulk specific density of the toner becomes too low, causing fog due to insufficient charging. When the ratio exceeds 0.91, the toner density is too low or the bulk specific density of the toner is too high, causing reduction in the image density. By setting $AD_2/AD_1$ in the above-mentioned range, the present invention makes it possible to regulate the toner density in the developing agent and to prevent the occurrence of fog due to insufficient charging and reduction in the image density.

In the present description, with respect to the above-mentioned bulk specific densities ($AD_1$ and $AD_2$) are based upon the JIS standard K-5101.

With respect to the carrier contained in the developing agent of the present invention, various carriers, such as a binder carrier in which magnetic particles are dispersed in a binder resin, a coated carrier in which magnetic particles are coated with resin and a carrier in which magnetic particles are as it is, may be used. However, in the present invention, from the viewpoint of easy control of the carrier bulk specific density $AD_1$), the developing agent bulk specific density ($AD_2$) and the ratio $AD_2/AD_1$ a binder carrier is preferably adopted.

In the case when a binder carrier is adopted as the carrier contained in the developing agent of the present invention, a production method of the binder carrier is not particularly limited, as long as the bulk specific density ($AD_1$) of the carrier, the bulk specific density ($AD_2$) of the developing agent and the ratio $AD_2/AD_1$ are controlled to be set in the above-mentioned ranges. A known method may be applied. For example, a method in which a binder resin and magnetic particles are mixed by a mixing device such as Henschel Mixer, the mixed product is fused and kneaded, the kneaded product is coarsely pulverized after cooled, the coarsely pulverized particles are finely pulverized, and the finely pulverized particles are classified, may be adopted.

In the above-mentioned production method for the binder carrier, a feather mill (made by Hosokawa Micron Corporation), etc., are used in the coarsely pulverizing process, and a mechanical pulverizer (ACM-10 Model: made by Hosokawa Micron Corporation), a Jet mill (IDS-Type 2: made by Nippon Pneumatic MFG. Co., LTD.), etc. are used in the finely pulverizing process.

Preferably in the production method for the binder carrier, the carrier particles subjected to the finely pulverized process are subjected to the classifying process and a surface-treatment process. In the surface-treatment process, Mechanofusion System (AMG-O Model; made by Hosokawa Micron Corporation) which mainly applies a mechanical impact simultaneously with heat, and Surfusing System (SFS-2 Model: made by Nippon Pneumatics MFG. Co., LTD.) which mainly applies a heating treatment, are preferably used.

The application of Mechanofusion System makes it possible to make the carrier particles spherical. The control of $AD_1$ becomes easier. In this case, the treatment temperature is preferably set at 70 to 150° C., preferably 80 to 130° C. The temperature of less than 70° C. provides only an insufficient degree of sphericity in the carrier shape, failing to provide a sufficient effect of the treatment. The temperature exceeding 150° C. causes aggregation among carrier particles, resulting in reduction in the yield.

The application of Surfusing System in the surface-treatment process not only makes the $AD_1$ control easier due to the conglobated carrier particles, but also improves the smoothness of the carrier surface and incorporates isolated magnetic particles into the carrier due to instantaneous fusion taken place on the surface of the carrier particles. Thus, it becomes possible to prevent image noise. In this case, the treatment temperature is preferably set at 150 to 350° C., more preferably 150 to 300° C. The temperature of less than 150° C. fails to achieve the incorporation of isolated magnetic particles into the carrier, causing image noises such as fogs. The temperature exceeding 350° C. causes a problem with fused resin components adhering to inner walls of the devices.

The carrier contained in the developing agent of the present invention is controlled to have a shape factor (SF) of 1.08 to 2.37, preferably 1.20 to 2.09, more preferably 1.40 to 2.00, the shape factor (SF) being represented by the following equation (I):

$$SF = \frac{L^2}{4pS} \quad \text{(I)}$$

(in which L represents a peripheral length of projection image, and S represents a projection area of projection image.) By controlling the shape factor so as to be in the above-mentioned range, it becomes possible to further improve the mixing properties and the electrification-build-up properties of the toner and the carrier, and consequently to effectively prevent fog and image irregularity. The carrier shape factor of less than 1.08 causes insufficient friction with toner, resulting in fog due to insufficient charging of toner. The factor exceeding 2.37 makes the carrier shape irregular, causing insufficient mixing with toner due to reduction in the fluidity and subsequent image irregularity.

In the present description, "peripheral length (L) of a projection image" and "projection area (S) of the projection image" are determined as follows: SEM images (magnification: ×1,000) obtained by a scanning type electronic microscope (JSM-840A; made by Nippon Denshi Datum K.K.) are image-processed, and the projection images thus obtained are measured in the peripheral length ($\mu$m) and the area ($(\mu m)^2$). However , the measuring method is not particularly limited by the above method, as long as the measurements are carried out based upon the above-mentioned measuring principle. In the present invention, both of the values of L and S are the one obtained as the average value of approximately 100 particles.

The carrier shape factor of this type is easily achieved by carrying out the above-mentioned surface-treatment process in the carrier production method. When the carrier shape factor is made smaller, Mechanofusion System is used in the surface-treatment process. When the carrier shape factor is made larger, the mechanical pulverizer (ACM-10 Model: made by Hosokawa Micron Corporation) or Jet mill (IDS-Type 2) is preferably used so as to carry out the finely pulverizing process, and after completion of a classiting process, the surface-treatment process may not be applied, or may be applied by Surfusing system. From the viewpoint of easy control of the shape factor, the treatment time in the above-mentioned surface-treatment process may be properly adjusted. That is, in the case of Mechanofusion System, it is set to 5 to 20 minutes, and preferably 10 to 15 minutes.

In the developing agent of the present invention, when the carrier shape factor is represented by SFc and the toner shape factor is represented by SFt, a value of SFc×SFt is set at 1.50 to 3.55, preferably 1.50 to 3.00, more preferably 1.80 to 2.60. By regulating the value in this manner, it becomes possible to ensure preferable mixing of the carrier with the toner and also to effectively prevent fog and density unevenness. In particular, by controlling SFc×SFt to the preferable range between 1.50 and 3.00, it becomes possible to further improve the effect of the prevention of density unevenness. If the value is less than 1.50, both the carrier and the toner have shapes close to a spherical shape. A preferable frictional charging of toner is not carried out. Fog tends to occur. If the value exceeds 3.55, both the carrier and the toner tend to have highly irregular shapes. The mixing properties become poor. Density unevenness tends to be caused.

With respect to the binder resin for carrier used in the present invention, a known thermoplastic resin usually used for carrier, such as, for example, a styrene resin, an acrylic resin, a styrene-acrylic resin, a polyester resin, an epoxy resin and a polyamide resin, may be adopted. Among these, a polyester resin and a styrene-acrylic resin are more preferably used. These resins may be used in a mixture.

With respect to the carrier binder resin, it is more preferably to use a polyester resin having the following properties: a glass transition point of 55 to 75° C., preferably 60 to 70° C.; a softening point of 90 to 145° C., preferably 100 to 140° C., a number average molecular weight of 3,000 to 50,000, preferably 5,000 to 30,000; and a ratio of weight-average molecular weight/number-average molecular weight of 5 to 50, preferably 10 to 40.

In the present invention, the glass transition point is measured by a differential scanning calorimeter (DSC-200: made by Seiko Instruments Inc.) in which: based upon alumina as the reference, 10 mg of a sample is measured at a temperature-rising rate of 10° C./min between 20 and 120° C., and a temperature of the shoulder in the main heat-absorption peak is defined as a glass transition point. The softening point is measured by a flow tester (CFT-500: made by Shimadzu Corporation) in which: 1 $cm^3$ of a sample is melted and flowed under the conditions of a thin pore of die (diameter 1 mm, length 1 mm), an applied pressure of 20 $kg/cm^2$ and a temperature-rising rate of 6° C./min, and the temperature corresponding to ½ of the height from a flowing start point to a flowing terminal point is defined as the softening point.

With respect to polyester resins preferably used in the present invention, known polyester resins conventionally used for producing carriers and toners may be used without any particular limitation. More specifically, a polyester resin which is obtained by polycondensating a known polyhydric alcohol component and a polycarboxylic acid component according to a known method may be used.

With respect to a styrene-acrylic resin preferably used in the present invention, known styrene-acrylic resins conventionally used for producing binder resins for carriers and toners may be used without any particular limitation. More specifically, it can be obtained by polymerizing a styrene monomer, an acrylic monomer, and a vinyl monomer, if necessary, according to a known method.

When a polyester resin and a styrene-acrylic resin are used in mixture, the mixing weight ratio of these resins is preferably set in the range of 10:90 to 90:10.

With respect to magnetic particles used in the present invention, any known magnetic particles, for example, ferrite, magnetite, iron particles, etc., may be used. Preferably, ferrite or magnetite is used.

A content of the magnetic particles is preferably set to 200 to 600 parts by weight, preferably 250 to 500 parts by weight, with respect to the 100 parts by weight of the binder resin. The content of the magnetic particles of less than 200 parts by weight makes $AD_1$ too small. The content exceeding 600 parts by weight makes $AD_1$ too large.

A volume-average particle size of the carrier is set to 20 to 50 $\mu$m, preferably 25 to 40 $\mu$m. The carrier particle size less than 20 $\mu$m makes $AD_1$ too small. The size exceeding 50 $\mu$m makes $AD_1$ too large. Both of the cases make it difficult to control $AD_1$.

In the carrier contained in the developing agent of the present invention, a dispersing agent, such as carbon black, silica, titania and alumina, may be contained. The addition of the dispersing agent makes it possible to improve the uniform dispersing properties of the magnetic particles in the binder resin. The amount of content of the dispersing agent is preferably set to 0.1 to 5 parts by weight with respect to 100 parts by weight of the binder resin.

The toner contained in the developing agent of the present invention may have either a negatively chargeable toner or a positively chargeable toner. Preferable is the negatively chargeable toner in the present invention.

A bulk specific density of the toner ($AD_3$) is appropriately set so as to have the bulk specific density ($AD_2$) of the developing agent and $AD_2/AD_1$ in the above-mentioned ranges. In general, it is preferable to adjust to 0.3 to 0.6 g/cc, preferably 0.35 to 0.5 g/cc. $AD_3$ is the value that is measured by the same measuring method as $AD_1$ and $AD_2$.

With respect to the toner shape factor (SFt), although not particularly limited, it is preferably designed so as to maintain the product of it and the carrier shape factor (SFc) in the above-mentioned range. In general, it is preferable to set to 1.1 to 2.5, preferably 1.2 to 2.0. The toner shape factor is a value represented by the above-mentioned equation (I), and S and L can be measured by the same method as described above.

The toner constituting the developing agent of the present invention can be produced by a known method, such as kneading-pulverizing method, a suspension polymerization method, an emulsion polymerization method, an emulsion dispersing method and capsulation method, with the use of a known toner binder resin, a colorant and a charge-control agent as well as desired additive agents, such as wax, which are conventionally used in the toner production. Among these production methods, it is preferable to use the kneading-pulverizing method from the viewpoint of production costs and production stability.

In the kneading-pulverizing method, toner particles are produced through the following processes: a mixing process in which toner particle components such as a toner binder resin and a colorant are mixed by a mixing device such as Henschel Mixer, a process in which the mixture is fused and kneaded, a process in which the kneaded materialial is cooled and then coarsely pulverized, a process in which the coarsely pulverized particles are finely pulverized, and a process in which the finely pulverized particles are classified. The toner particles are adjusted so as to have a volume-average particle size of 4 to 10 $\mu$m, preferably 6 to 9 $\mu$m, from the viewpoint of image reproducibility with high definition.

With respect to the toner binder resin, thermoplastic resins which have been conventionally used as binder resins for toners, such as, for example, styrene resins, acrylic resins, styrene-acrylic resins and polyester resins, may be used. In the case of a negatively chargeable toner, polyester resins are preferably used. In the case of a positively chargeable toner, styrene-acrylic resins are preferably used.

The colorant used in the present invention is not particularly limited, and colorants which have been conventionally used in the electrophotography may be used; examples of these are listed as follows:

As for black pigments, for example, carbon black, copper oxide, manganese dioxide, aniline black, active carbon, ferrite, magnetite, etc. are listed.

As for yellow pigments, for example, chrome yellow, zinc yellow, cadmium yellow, yellow iron oxide, mineral fast yellow, nickel titanium yellow, enable yellow, naphtol yellow S, Hansa Yellow G, Hansa Yellow 10G, benzidine yellow G, benzidine yellow GR, quinoline yellow lake, permanent yellow NCG, Tartrazine lake, etc. are listed.

As for red pigments, for example, red chrome yellow, molybdenum orange, permanent orange GTR, pyrazolone orange, vulcan orange, Indanthrene Brilliant Orange RK, benzidine orange G, Indanthrene Brilliant Orange GK, iron oxide red, cadmium red, minium, permanent red 4R, resol red, pyrazolone red, watching red, Lake Red C, Lake Red D, Brilliant Carmine 6B, Eosine Lake, Rhodamine Lake B, alizarine lake, Brilliant Carmine 3B, permanent orange GTR, vulcan fast orange GG, permanent red F4RH, permanent carmine FB, etc. are listed.

As for blue pigments, for example, Prussian blue, cobalt blue, alkali blue lake, Victorian Blue Lake, phthalocyanine blue, etc. are listed.

With respect to an amount of addition of these colorants, although not particularly limited, it is preferable to use 1 to 20 parts by weight, preferably 3 to 15 parts by weight, of these colorants, with respect to 100 parts by weight of the toner binder resin.

Other desired additive agents, for example, a charge-control agent, wax, etc., may be contained in the toner. With respect to the charge-control agent, when the toner is intended to be negatively charged, a negative charge-control agent is used. When the toner is intended to be positively charged, a positive charge-control agent is used. As for negative charge-control agent applicable to the present invention, metallic complexes of salicylic acid, metal-containing azo dyes, calix arene compounds, boron-containing compounds, etc. are listed. As for positive charge-control agents, nigrosine dyes, triphenylmethane compounds, quaternary ammonium salt compounds, etc. are listed. In the present invention, it is preferable to use negative charge-control agents. An amount of addition thereof is preferably set to 0.1 to 5 parts by weight with respect to 100 parts by weight of the toner binder resin.

With respect to the wax, paraffin waxes, such as low molecular polypropylene, low molecular polyethylene, carnauba wax and beeswax, and acrylic waxes are preferably used; however, these are not particularly limited, as long as they are not compatible with a thermoplastic resin used as the binder resin of the toner and have an isolating properties. The amount of addition thereof is preferably set to 1 to 10 parts by weight with respect to 100 parts by weight of the toner binder resin.

A fluidizing agent may be externally added to the toner constituting the developing agent of the present invention. Examples of the fluidizing agent include silica fine particles, titanium dioxide particles, alumina fine particles, magnesium fluoride fine particles, silicon carbide fine particles, boron carbide fine particles, titanium carbide fine particles, zirconium carbide fine particles, boron nitride fine particles, titanium nitride fine particles, zirconium nitride fine particles, magnetite fine particles, molybdenum disulfide fine particles, aluminum stearate fine particles, magnesium stearate fine particles, zinc steareate fine particles, etc. These fine particles are preferably subjected to a hydophobic treatment with a silane coupling agent, a titanate coupling agent, a higher fatty acid, silicone oil, etc.

An amount of addition of the fluidizing agent is set to 0.05 to 5 parts by weight, preferably 0.1 to 3 parts by weight, with respect to 100 parts by weight of the toner.

In the developing agent of the present invention, the aforementioned factor, $AD_2/AD_1$ is highly dependent on the content of the toner in the developing agent. Therefore, it is preferable to set the toner content appropriately, and is set to 3 to 20% by weight, preferably 5 to 18% by weight. The toner content less than 3% by weight tends to fail to obtain sufficient image density and to cause a change (reduction) in the image density during an endurance copying processes. The toner content exceeding 20% by weight tends to fail to sufficiently charge the toner, causing fog in the image, or tends to cause reduction in the fluidity of the developing agent, resulting in unevenness on the sleeve and unevenness in the image density.

Such the above developing agent of the present invention is preferably used in a developing machine of the two-component developing system. When the developing agent of the present invention is used in an image-forming method in which the two-component developing system is adopted, it becomes possible to prevent occurrence of fog and image irregularity as well as reduction in the image density for a long time.

Referring to FIG. 1, an explanation will be given of a two-component developing method. In this developing machine 10, a developing agent 1 containing toner T and carrier is housed inside thereof. A cylindrical developing sleeve 11 is used as a developing-transporting member 11 for transporting the developing agent, in which a magnet roller 11*a* having a plurality of magnetic poles $N_1$, $S_1$, $N_2$, $S_2$ and $N_3$ is arranged at the inner circumference of the sleeve 11. The developing sleeve 11 is rotatably arranged in a manner so as to face a photosensitive member 2, which is an image-supporting member, with a predetermined distance Ds in a developing area.

This developing sleeve 11 is rotated in a direction reversed to that of the photosensitive member 2 so that the developing sleeve 11 and the photosensitive member 2 are moved in the same direction at the developing area at which the developing sleeve 11 and the photosensitive member 2 face each other. With the rotation of the developing sleeve 11, the developing agent 1 housed inside the developing machine 10 is transported toward the photosensitive member 2 in the form of magnetic brush formed due to a magnetic function exerted by the said magnet roller 11*a*.

A developing bias power source 12 is connected to the developing sleeve 11. A developing bias voltage, which is an AC voltage or a voltage formed by superposing a DC voltage on an AV voltage, is applied from the developing bias power source 12 so that a vibrating electric field is applied to the developing area.

On the upstream side in the transporting direction of the developing agent 1 from the developing area at which the developing sleeve 11 faces the photosensitive member 2, at a position facing the magnetic pole $N_1$ of the above-mentioned magnetic roller 11*a*, a magnetic blade 13*a* is placed as a regulating member 13 with a predetermined gap to the developing sleeve 11 so that the amount of the developing agent 1 on the developing sleeve 11 is regulated by this magnetic blade 13*a*.

In the developing machine 10, a toner-storing section 14 storing toner T is attached to the upper portion thereof Toner T in the developing agent 1 is supplied onto the photosensitive member 2 from the developing sleeve 11 in the developing process. When the toner density of the developing agent 1 inside the developing machine 10 is lowered, a toner-supplying roller 15, placed below the toner-storing section 14, is rotated so that toner T stored in the toner-storing section 14 is supplied to the developing agent 1 inside the developing machine 10.

In this developing machine 10, the amount of the developing agent 1 on the developing sleeve 11 is regulated by the magnetic blade 13*a* installed on the upstream side in the transporting direction of the developing agent 1 from the developing area at which the developing sleeve 11 and the photosensitive member 2 faces each other. The developing agent 1, formed as a thin layer on the developing sleeve 11, is transported to the developing area facing the photosensitive member 2, and a developing bias voltage is applied from the developing bias power source 12 so as to apply a vibrating electric field to the developing area so that toner T in the developing agent 1 transported by the developing sleeve 11 is supplied to a latent image portion on the photosensitive member 2 from the developing sleeve 11. Thus, a developing process is carried out.

With respect to the developing agent transported to the developing area by the developing-transporting member, if the amount thereof is too small, toner to be supplied to the image-supporting member becomes insufficient, failing to provide images having sufficient image density. For this reason, the gap between the developing sleeve and the magnetic blade is set to 0.1 to 1 mm, preferably 0.2 to 0.6 mm. The amount of the developing agent to be transported to the developing area by the developer-transporting member is set in the range of 0.7 to 10 mg/cm$^2$, preferably 1 to 7 mg/cm$^2$.

When the vibrating electric field is exerted between the developer-transporting member and the image-supporting member in the developing area as described above in the developing process, if the vibrating electric field is too weak, the shift of charge in the carrier after the toner is transferred becomes inferior, causing a counter charge to remain on the carrier, with the result that the carrier tends to adhere to the image-supporting member. If the vibrating electric field is too strong, leakage tends to occur between the developer-transporting member and the image-supporting member. For this reason, supposing that the distance between the developer-transporting member and the image-supporting member at the developing area is Ds and the peak-to-peak value of the AC voltage to be applied is Vp-p, the vibrating voltage (Vp-p/Ds) is preferably set in the range of 2 to 6 kV/mm, preferably 3 to 5 kV/mm. It is more preferable to multiplex thereon a DC voltage of −300 to −400 V.

The developing agent of the present invention is also effectively applied to a developing machine in which a toner-recycling system is adopted in a developing machine having the structure as shown FIG. 1. In the case of an image-forming method using the two-component developing system and the toner-recycling system, the application of the developing agent of the present invention makes it possible to prevent the occurrence of fog and image irregularity as well as reduction in the image density for a long time. The toner that is recovered through the toner-recycling system generally has its post-processing agent (fluidizing agent) separated therefrom, with the result that its fluidizing properties are lowered. Therefore, the recovered toner has low probability of contact with the carrier, is inferior in the frictional charging properties, and consequently, tends to cause fog and reduction in the image density. However, the above-mentioned carrier in the present invention allows even such a recovered toner to be effectively charged, thereby making it possible to prevent the above-mentioned problems due to the reduction in the fluidizing properties.

Figure 2:
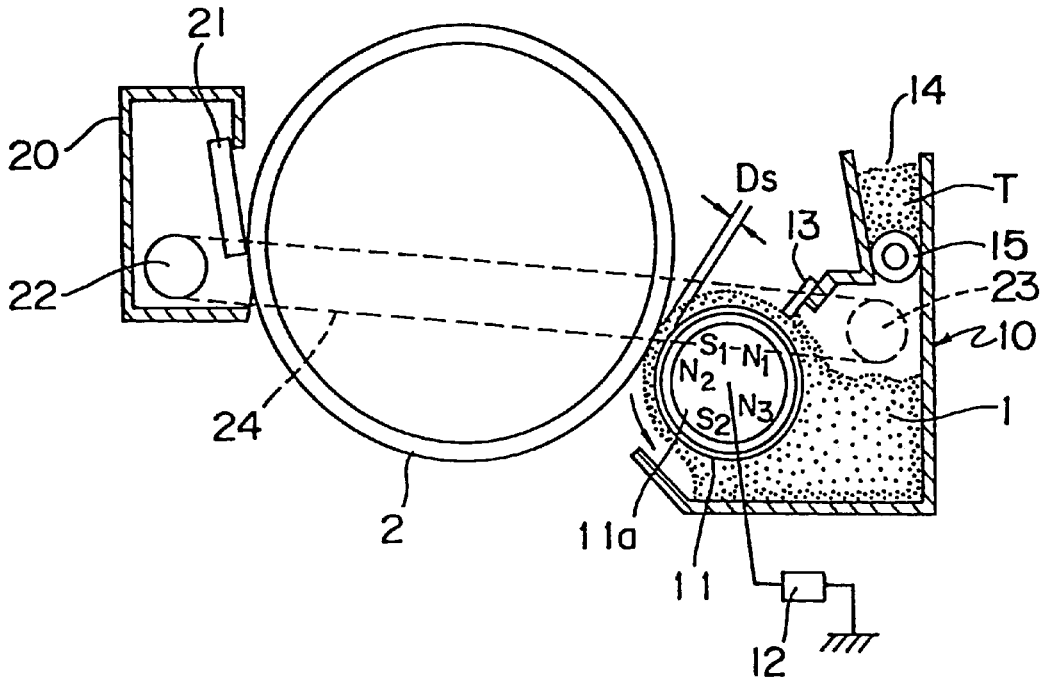
FIG. 2 is a schematic view showing the structure of a developing machine of FIG. 1 with a toner recycling system adopted.

Referring to FIG. 2, an explanation will be given of one example of a developing machine using the two-component developing method and the toner recycling system. FIG. 2 shows the same construction as that of FIG. 1 except that the toner-recycling system is provided therein. The toner recycling system means a system in which residual toner on the image-supporting member is recovered by a known method and the toner thus recovered is transported into the developing machine so as to use it again in a developing operation.

In FIG. 2, the residual toner on the image-supporting member is recovered by a cleaning brush 21 inside the cleaning device 20. The toner thus recovered is transported into the developing machine by a belt 24 that passes over a roller 22 on the cleaning device side and a roller 23 on the developing machine side, and again used for a developing operation together with the developing agent 1 stored in the developing machine. In this manner, the application of the toner recycling system makes it possible to use the toner effectively in the developing operation.

The following description will discuss examples of the present invention in detail.

EXAMPLES

Production of carrier A

| | |
|---|---|
| *Polyester resin (Glass transition point 63° C., Softening point 122° C.) | 100 parts by weight |
| *Ferrite (MFP-2; made by TDK K. K.) | 350 parts by weight |
| *Carbon black (#970; Mitsubishi Chemical Corporation) | 2 parts by weight |

The above-mentioned ingredients were sufficiently mixed in Henschel Mixer, and then melt and kneaded by means of a bent twin-screw extruding kneader (PCM-65 made by Ikegai Tekkou K.K.) at 180° C. This kneaded material was coarsely pulverized by a feather mill, finely pulverized by a mechanical pulverizer (ACM-10 Model; made by Hosokawa Micron Corporation), classified by an air classifier (MS-1 Model; made by Hosokawa Micron Corporation). The classified product was subjected to a surface-modifying treatment at 250° C. by Surfusing System (SFS-2 Model; made by Nippon Pneumatics MFG. Co. LTD.). Thus, carrier A having an average particle size of 30 $\mu$m was obtained.

Production of carrier B

| | |
|---|---|
| *Styrene-acrylic resin (Glass transition point 65° C., Softening point 130° C.) | 100 parts by weight |
| *Magnetite (RB-BL; Titan Kogyo K. K.) | 300 parts by weight |
| *Carbon black (MA#8; Mitsubishi Chemical Corporation) | 2.5 parts by weight |

The above-mentioned ingredients were sufficiently mixed in Henschel Mixer, and then melt and kneaded by a bent twin-screw extruding kneader (PCM-30 made by Ikegai Tekkou K.K.) at 180° C. This kneaded material was coarsely pulverized by a feather mill, finely pulverized by Jet Mill (IDS-2 Model; made by Nippon Pneumatic MFG. Co. LTD.), classified by an air classifier (MS-1 Model; made by Hosokawa Micron Corporation). The classified product was subjected to a surface-modifying treatment at 250° C. by Surfusing System (SFS-2 Model; made by Nippon Pneumatic MFG. Co. LTD.). Thus, carrier B having an average particle size of 35 $\mu$m was obtained.

Production of carrier C

| | |
|---|---|
| *Polyester resin (Glass transition point 63° C., Softening point 122° C.) | 100 parts by weight |
| *Magnetite (RB-BL; Titan Kogyo K. K.) | 350 parts by weight |
| *Carbon black (MA#8; Mitsubishi Chemical Corporation) | 2 parts by weight |

The above-mentioned ingredients were sufficiently mixed in Henschel Mixer, and then melt and kneaded by a bent twin-screw extruding kneader (PCM-65 made by Ikegai Tekkou K.K.) at 180° C. This kneaded material was coarsely pulverized by a feather mill, finely pulverized by a mechanical pulverizer (ACM-10 Model; made by Hosokawa Micron Corporation), classified by an air classifier (MS-1 Model; made by Hosokawa Micron Corporation). The classified product was subjected to a surface-modifying treatment for 10 minutes by Mechanofusion System (AMG-O Model; made by Hosokawa Micron Corporation), with the rotor rotational speed being adjusted so as to set the processing temperature at 90° C. Thus, carrier C having an average particle size of 35 $\mu$m was obtained.

Production of carrier D

The same method as the production method of carrier A was carried out except that carrier materials as shown in Table I were used and that the processing temperature by Surfusing system was set to 150° C.; thus, carrier D having an average particle size of 25 μm was obtained.

Production of carrier E

The same method as the production method of carrier A was carried out except that carrier materials as shown in Table I were used and that the processing temperature by Surfusing system was set to 300° C.; thus, carrier E having an average particle size of 40 μm was obtained.

Production of carrier F

The same method as the production method of carrier C was carried out except that carrier materials as shown in Table 1 were used and that the processing temperature by Mechanofusion system was set to 120° C.; thus, carrier F having an average particle size of 30 μm was obtained.

Production of carrier G

The same method as the production method of carrier B was carried out except that carrier materials as shown in Table 1 were used and that the processing temperature by Surfusing system was set to 150° C.; thus, carrier D having an average particle size of 35 μm was obtained.

Production of carrier H

The same method as the production method of carrier B was carried out except that carrier materials as shown in Table 1 were used and that the processing temperature by Surfusing system was set to 270° C.; thus, carrier H having an average particle size of 30 μm was obtained.

Production of carrier I

The same method as the production method of carrier C was carried out except that carrier materials as shown in Table 1 were used and that the processing temperature by Mechanofusion system was set to 80° C.; thus, carrier I having an average particle size of 30 μm was obtained.

Production of carrier J

The same method as the production method of carrier B was carried out except that carrier materials as shown in Table 1 were used and that the processing temperature by Surfusing system was set to 200° C.; thus, carrier J having an average particle size of 25 μm was obtained.

Production of carrier K

The same method as the production method of carrier C was carried out except that carrier materials as shown in Table 1 were used and that the processing temperature by Mechanofusion system was set to 110° C.; thus, carrier K having an average particle size of 40 μm was obtained.

Materials used in the above-mentioned production of carriers are listed in Table 1, together with device models used in the finely pulverizing process, device models used in the surface-modifying process and respective processing temperatures. In Table 1, "PES" refers to polyester resins, "St-Ac" refers to styrene-acrylic resins, "Tg" refers to a glass transition point of a binder resin to be used, and "Tm" refers to a softening point of the resin. With respect to magnetic particles, Magnetite RB-BL (made by Titan Kogyo K.K.), Magnetite EPT-1000 (made by Toda Kogyo K.K.), Ferrite MFP-2 (made by TDK K.K.) were used. With respect to carbon black, #970 (made by Mitsubishi Chemical Corporation), MA#8 (made by Mitsubishi Chemixcal Corporation) and REGAL 330 (made by Cabot Corporation) were used.

TABLE 1

| | Binder resin | | | | Magnetic particles | | Carbon black | | | Surface treatment process | |
|---|---|---|---|---|---|---|---|---|---|---|---|
| Carrier type | Type | Tg (° C.) | Tm (° C.) | Amount of addition (parts by weight) | Type | Amount of addition (parts by weight) | Type | Amount of addition (parts by weight) | Finely pulverizing process Device model | Type | Processing temperature (° C.) |
| A | PES | 63 | 122 | 100 | Ferrite MFP-2 | 350 | #970 | 2 | ACM-10 model | SFS-2 type | 250 |
| B | St-Ac | 65 | 130 | 100 | Magnetite RB-BL | 300 | MA #8 | 2.5 | IDS-2 model | SFS-2 type | 250 |
| C | PES | 63 | 122 | 100 | Magnetite RB-BL | 350 | MA #8 | 2 | ACM-10 model | AGM-0 type | 90 |
| D | St-Ac | 65 | 130 | 100 | Magnetite EPT-1000 | 400 | REGAL330 | 1.5 | ACM-10 model | SFS-2 type | 150 |
| E | PES<br>St-Ac | 63<br>65 | 122<br>130 | 80<br>20 | Ferrite MFP-2 | 350 | #970 | 2 | ACM-10 model | SFS-2 type | 300 |
| F | PES<br>St-Ac | 63<br>65 | 122<br>130 | 70<br>30 | Ferrite MFP-2 | 300 | REGAL330 | 2.5 | ACM-10 model | AMG-0 type | 120 |
| G | PES<br>St-Ac | 63<br>65 | 122<br>130 | 80<br>20 | Ferrite MFP-2 | 350 | #970 | 2 | IDS-2 model | SFS-2 type | 150 |
| H | PES | 63 | 122 | 100 | Magnetite RB-BL | 350 | #970 | 2 | IDS-2 model | SFS-2 type | 270 |
| I | St-Ac | 65 | 130 | 100 | Magnetite RB-BL | 300 | MA #8 | 2 | ACM-10 model | AMG-0 type | 80 |
| J | PES | 63 | 122 | 100 | Magnetite RB-BL | 300 | #970 | 3 | IDS-2 model | SFS-2 type | 200 |
| K | St-Ac | 65 | 130 | 100 | Magnetite MFP-2 | 400 | REGAL330 | 2 | ACM-10 model | AMG-0 type | 110 |

Production of toner a

| | |
|---|---|
| *Thermoplastic polyester resin (Softening point 120° C., Glass transition point 61° C.) | 100 parts by weight |
| *Carbon black (Mogul L: Cabot Corporation) | 8 parts by weight |
| *Low molecular weight propylene (Viscol 550P: made by Sanyo Chemical Industries LTD) | 3 parts by weight |
| *Negative charge-control agent | 5 parts by weight |

-continued

| |
|---|
| (Bontron S-34: made by Orient Chemical Industries LTD) |

The above-mentioned ingredients were sufficiently mixed, and then melt and kneaded by a bent twin-screw extruding kneader at 140° C. After having been cooled, this kneaded material was coarsely pulverized by a feather mill, finely pulverized byte jet mill, classified by an air classifier. Thus, black fine particles having a volume-average particle size of 9 μm were obtained. To 100 parts by weight of the black fine particles were added 0.3 part by weight of hydrophobic silica (H-2000: made by Clairiant Gmbh). The resultant mixture was processed by Henschel Mixer (made by Mitsui Miike Kakouki K.K.) at 1,000 rpm for one minute to give a negatively chargeable toner. The resulting toner is referred to as toner a. Toner a has a shape factor (SFt) of 1.5.

Examples 1 Through 11 and Comparative Examples 1 Through 8

The above-mentioned carriers A through K and toner a were mixed so as to give developing agents in which the toner weight ratios (Tc) thereof were set at ratios as shown in Table 1 respectively. The mixing process was carried out for one hour by a roll mill.

Table 2 shows the kinds, the average particle size, the bulk specific density ($AD_1$) and the shape factor (SFc) of the carriers used in the respective Examples and Comparative Examples, as well as the bulk specific density ($AD_2$), the toner weight ratio (Tc), $AD_2/AD_1$ and SFc×SFt of the developing agents thus obtained.

TABLE 2

| | Carrier type (Average particle size (μm)) | $AD_1$ (g/cc) | SFc | Tc (Weight %) | $AD_2$ (g/cc) | $AD_2/AD_1$ | SFc × SFt |
|---|---|---|---|---|---|---|---|
| Example 1 | A (30) | 1.25 | 1.80 | 15 | 0.98 | 0.78 | 2.70 |
| Example 2 | B (35) | 1.11 | 2.19 | 13 | 0.92 | 0.83 | 3.29 |
| Example 3 | C (35) | 1.40 | 1.21 | 17 | 1.04 | 0.74 | 1.82 |
| Example 4 | D (25) | 1.15 | 2.01 | 16 | 0.85 | 0.74 | 3.02 |
| Example 5 | E (40) | 1.35 | 1.65 | 12 | 1.14 | 0.84 | 2.48 |
| Example 6 | E (40) | 1.35 | 1.65 | 18 | 0.95 | 0.70 | 2.48 |
| Example 7 | D (25) | 1.15 | 2.01 | 12 | 1.03 | 0.90 | 3.02 |
| Example 8 | F (30) | 1.25 | 1.10 | 17 | 0.98 | 0.78 | 1.65 |
| Example 9 | G (35) | 1.25 | 2.35 | 13 | 0.98 | 0.78 | 3.53 |
| Example 10 | H (30) | 1.25 | 2.10 | 14 | 0.98 | 0.78 | 3.15 |
| Example 11 | I (30) | 1.25 | 1.25 | 16 | 0.98 | 0.78 | 1.88 |
| Comparative Example 1 | J (25) | 1.05 | 2.30 | 12 | 0.90 | 0.86 | 3.45 |
| Comparative Example 2 | K (40) | 1.45 | 1.15 | 17 | 1.08 | 0.74 | 1.73 |
| Comparative Example 3 | D (25) | 1.15 | 2.01 | 17 | 0.81 | 0.70 | 3.02 |
| Comparative Example 4 | E (40) | 1.35 | 1.65 | 11 | 1.18 | 0.87 | 2.48 |
| Comparative Example 5 | E (40) | 1.35 | 1.65 | 22 | 0.92 | 0.68 | 2.48 |
| Comparative Example 6 | D (25) | 1.15 | 2.01 | 8 | 1.07 | 0.93 | 3.02 |
| Comparative Example 7 | K (40) | 1.45 | 1.15 | 10 | 1.33 | 0.92 | 1.73 |
| Comparative Example 8 | J (25) | 1.05 | 2.30 | 18 | 0.72 | 0.69 | 3.45 |

The above described physical values were measured as following method.

Measurement on carrier bulk specific density ($AD_1$) and developing agent bulk specific density ($AD_2$).

The carrier bulk specific density ($AD_1$) and the developing agent bulk specific density ($AD_2$) were measured based upon JIS standard K-51101.

(Measurements on shape factors of carriers and toners)

An SEM image (×1000) of a carrier or a toner photographed by a scanning-type electron microscope (JSM-840A; made by Nippon Denshi Datum Corporation) was image-processed by an image processing device (Image Hyper II; Inter Quest K.K.), and measurements were carried out on the projection area (S) and the peripheral length (L) of the projection image. Then, calculations were made from the resulting values based upon the aforementioned equation (I).

(Measurements on carrier average particle sizes and toner volume-average particle sizes)

The carrier average particle size was measured by Coulter Multisizer (made by Coulter K.K.) by measuring the relative weight distribution on the respective particle sizes by the use of an aperture tube diameter of 280 μm. The toner volume-average particle size was measured by Coulter Multisizer (made by Coulter K.K.) by measuring the relative weight distribution on the respective particle sizes by the use of an aperture tube diameter of 100 μm.

(Experimental Example 1)

Each of the developing agents was fed to a copying machine (Di-30 made by Minolta K.K.) having a developing machine schematically shown in FIG. 1, and was subjected to endurance copying processes of 300,000 sheets on an image having a B/W ratio of 10% under N/N environment (25° C., 50%). Then, copies, obtained in the respective stages of 0-sheet stage (initial stage), 10,000-sheet stage, 50,000-sheet stage, 100,000-sheet stage, 150,000-sheet stage, 200,000-sheet stage, 250,000-sheet stage and 300,000-sheet stage, were evaluated on the following evaluation items. With respect to an image having a B/W ratio of 50%, endurance copying processes were carried out, and copies, obtained in the respective stages of 110,000-sheet stage, 210,000-sheet stage and 310,000-sheet stage, were evaluated on the following evaluation items. The results of the evaluation are collectively shown in Tables 3 to 5.

The setting conditions of the copying machine were adjusted as follows; the distance between the developing sleeve and the magnetic blade: 0.4 mm, the amount of carriage of the developing agent to be carried to the developing area by the developing sleeve: 5.0 mg/cm$^2$, the peripheral velocity of the photosensitive member: 165 mm/s; the peripheral velocity of the developing sleeve: 300 mm/s; the surface electric potential at a portion of the photosensitive member to which toner T is supplied: −450 V; the surface electric potential at the other portion of the photosensitive member to which no toner T is supplied: −100 V; and the minimum distance at the opposing position between the photosensitive member and the developing sleeve: 0.4 mm. At the developing area, a DC voltage of −350 V from the developing bias power source and an AC voltage, which has a peak-to-peak value Vp-p of 1.5 kV, a frequency of 3 kHz with a rectangular wave and a duty ratio (developing:recovering) of 1:1, are superposed with each other.

Fog

Copied images in each of the endurance coping stages were visually observed for fog on its white portion, and evaluation was made based on the following ranks:

◎; No fog was observed.

○; Fog was observed slightly; however, no problem arose in practical use.

Δ; Fog was observed, and problems arose in practical use.

X; Fog was observed all over, and problems arose in practical use.

Image density

The image density of copied images in each of the endurance copying stages was measured on its solid (solid black) portion by a reflection densitometer (made by Macbeth K.K.), and evaluation was made based on the following ranks. The ranks "○" and more raise no problems in practical use.

◎; not less than 1.4;

○; in the range of not less than 1.2 to less than 1.4;

Δ; in the range of not less than 1.0 to less than 1.2; and

X; less than 1.0

Density unevenness

One sheet of copy of solid black image was obtained in each of the endurance copying stages, and the density dispersion in the sheet of the copied image was measured, and evaluation was made based on the following ranks. The ranks "○" and more raise no problems in practical use. In this case, densities at five points, that is, the four corners and center of the copied image, were measured by a reflection densitometer (made by Macbeth K.K.), and the evaluation was made on the dispersion % obtained from the average value thereof.

◎; not more than 5%;

○; in the range of more than 5% to not more than 10%;

Δ; in the range of more than 10% to not more than 20%; and

X; more than 20%.

TABLE 3

| | | | (Evaluation: Fog) | | | | | | | | | | |
|---|---|---|---|---|---|---|---|---|---|---|---|---|---|
| | | | B/W 10% | | | | B/W 50% | B/W 10% | | B/W 50% | B/W 10% | | B/W 50% |
| | Carrier | Toner | Initial | 10,000 sheets | 50,000 sheets | 100,000 sheets | 110,000 sheets | 150,000 sheets | 200,000 sheets | 210,000 sheets | 250,000 sheets | 300,000 sheets | 310,000 sheets |
| Example 1 | A | a | ◎ | ◎ | ◎ | ◎ | ◎ | ◎ | ◎ | ◎ | ◎ | ◎ | ◎ |
| Example 2 | B | a | ◎ | ◎ | ◎ | ◎ | ◎ | ◎ | ◎ | ◎ | ◎ | ○ | ○ |
| Example 3 | C | a | ◎ | ◎ | ◎ | ◎ | ◎ | ◎ | ◎ | ○ | ○ | ○ | ○ |
| Example 4 | D | a | ◎ | ◎ | ◎ | ◎ | ◎ | ◎ | ◎ | ◎ | ◎ | ○ | ○ |
| Example 5 | E | a | ◎ | ◎ | ◎ | ◎ | ◎ | ◎ | ◎ | ◎ | ◎ | ◎ | ○ |
| Example 6 | E | a | ◎ | ◎ | ◎ | ◎ | ◎ | ◎ | ○ | ○ | ○ | ○ | ○ |
| Example 7 | D | a | ◎ | ◎ | ◎ | ◎ | ◎ | ◎ | ◎ | ◎ | ◎ | ◎ | ◎ |
| Example 8 | F | a | ◎ | ◎ | ◎ | ◎ | ◎ | ◎ | ◎ | ◎ | ○ | ○ | ○ |
| Example 9 | G | a | ◎ | ◎ | ◎ | ◎ | ◎ | ◎ | ◎ | ◎ | ◎ | ◎ | ○ |
| Example 10 | H | a | ◎ | ◎ | ◎ | ◎ | ◎ | ◎ | ◎ | ◎ | ◎ | ◎ | ○ |
| Example 11 | I | a | ◎ | ◎ | ◎ | ◎ | ◎ | ◎ | ◎ | ◎ | ◎ | ○ | ○ |
| Comparative Example 1 | J | a | ◎ | ◎ | ◐ | ◎ | ◎ | ◎ | ○ | ○ | ○ | ○ | ○ |
| Comparative Example 2 | K | a | ◎ | ◎ | ◎ | ○ | ○ | ○ | Δ | Δ | Δ | Δ | Δ |
| Comparative Example 3 | D | a | ◎ | ◎ | ◎ | ◎ | ◎ | ○ | ○ | ○ | ○ | ○ | ○ |
| Comparative Example 4 | E | a | ◎ | ◎ | ◎ | ◎ | ◎ | ○ | ○ | ○ | ○ | ○ | ○ |
| Comparative Example 5 | E | a | ◎ | ◎ | ○ | ○ | ○ | Δ | Δ | Δ | Δ | Δ | Δ |
| Comparative Example 6 | D | a | ◎ | ◎ | ◎ | ◎ | ◎ | ◎ | ○ | ○ | ○ | ○ | ○ |
| Comparative Example 7 | K | a | ○ | ○ | ○ | Δ | Δ | Δ | Δ | Δ | X | X | X |
| Comparative Example 8 | J | a | ○ | Δ | Δ | Δ | Δ | Δ | X | X | X | X | X |

TABLE 4

(Evaluation: Image density)

| | | | B/W 10% | | | | B/W 50% | B/W 10% | | B/W 50% | B/W 10% | | B/W 50% |
|---|---|---|---|---|---|---|---|---|---|---|---|---|---|
| | Carrier | Toner | Initial | 10,000 sheets | 50,000 sheets | 100,000 sheets | 110,000 sheets | 150,000 sheets | 200,000 sheets | 210,000 sheets | 250,000 sheets | 300,000 sheets | 310,000 sheets |
| Example 1 | A | a | ◎ | ◎ | ◎ | ◎ | ◎ | ◎ | ◎ | ◎ | ◎ | ◎ | ◎ |
| Example 2 | B | a | ◎ | ◎ | ◎ | ◎ | ◎ | ◎ | ◎ | ◎ | ◎ | ◎ | ◎ |
| Example 3 | C | a | ◎ | ◎ | ◎ | ◎ | ◎ | ◎ | ◎ | ◎ | ◎ | ◎ | ○ |
| Example 4 | D | a | ◎ | ◎ | ◎ | ◎ | ◎ | ◎ | ◎ | ○ | ○ | ○ | ○ |
| Example 5 | E | a | ◎ | ◎ | ◎ | ◎ | ◎ | ◎ | ○ | ○ | ○ | ○ | ○ |
| Example 6 | E | a | ◎ | ◎ | ◎ | ◎ | ◎ | ◎ | ◎ | ◎ | ◎ | ○ | ○ |
| Example 7 | D | a | ◎ | ◎ | ◎ | ◎ | ◎ | ◎ | ○ | ○ | ○ | ○ | ○ |
| Example 8 | F | a | ◎ | ◎ | ◎ | ◎ | ◎ | ◎ | ◎ | ◎ | ◎ | ◎ | ○ |
| Example 9 | G | a | ◎ | ◎ | ◎ | ◎ | ◎ | ◎ | ◎ | ◎ | ◎ | ○ | ○ |
| Example 10 | H | a | ◎ | ◎ | ◎ | ◎ | ◎ | ◎ | ◎ | ◎ | ◎ | ◎ | ○ |
| Example 11 | I | a | ◎ | ◎ | ◎ | ◎ | ◎ | ◎ | ◎ | ◎ | ◎ | ◎ | ◎ |
| Comparative Example 1 | J | a | ◎ | ◎ | ◎ | ◎ | ◎ | ○ | ○ | ○ | ○ | ○ | ○ |
| Comparative Example 2 | K | a | ◎ | ◎ | ◎ | ◎ | ◎ | ◎ | ○ | ○ | ○ | ○ | ○ |
| Comparative Example 3 | D | a | ◎ | ◎ | ◎ | ○ | ○ | ○ | ○ | ○ | ○ | Δ | Δ |
| Comparative Example 4 | E | a | ◎ | ◎ | ◎ | ◎ | ○ | ○ | ○ | ○ | Δ | Δ | Δ |
| Comparative Example 5 | E | a | ◎ | ◎ | ◎ | ◎ | ◎ | ◎ | ○ | ○ | ○ | ○ | ○ |
| Comparative Example 6 | D | a | ◎ | ◎ | ◎ | ◎ | ○ | ○ | ○ | ○ | Δ | Δ | Δ |
| Comparative Example 7 | K | a | ◎ | ◎ | ○ | ○ | Δ | Δ | Δ | X | X | X | X |
| Comparative Example 8 | J | a | ○ | Δ | Δ | Δ | Δ | Δ | Δ | Δ | X | X | X |

TABLE 5

(Evaluation: Density unevenness)

| | | | B/W 10% | | | | B/W 50% | B/W 10% | | B/W 50% | B/W 10% | | B/W 50% |
|---|---|---|---|---|---|---|---|---|---|---|---|---|---|
| | Carrier | Toner | Initial | 10,000 sheets | 50,000 sheets | 100,000 sheets | 110,000 sheets | 150,000 sheets | 200,000 sheets | 210,000 sheets | 250,000 sheets | 300,000 sheets | 310,000 sheets |
| Example 1 | A | a | ◎ | ◎ | ◎ | ◎ | ◎ | ◎ | ◎ | ◎ | ◎ | ◎ | ◎ |
| Example 2 | B | a | ◎ | ◎ | ◎ | ◎ | ◎ | ◎ | ◎ | ○ | ○ | ○ | ○ |
| Example 3 | C | a | ◎ | ◎ | ◎ | ◎ | ◎ | ◎ | ◎ | ◎ | ◎ | ◎ | ○ |
| Example 4 | D | a | ◎ | ◎ | ◎ | ◎ | ◎ | ◎ | ◎ | ○ | ○ | ○ | ○ |
| Example 5 | E | a | ◎ | ◎ | ◎ | ◎ | ◎ | ◎ | ◎ | ◎ | ◎ | ◎ | ○ |
| Example 6 | E | a | ◎ | ◎ | ◎ | ◎ | ◎ | ◎ | ◎ | ◎ | ◎ | ◎ | ○ |
| Example 7 | D | a | ◎ | ◎ | ◎ | ◎ | ◎ | ◎ | ◎ | ◎ | ◎ | ○ | ○ |
| Example 8 | F | a | ◎ | ◎ | ◎ | ◎ | ◎ | ◎ | ◎ | ◎ | ◎ | ◎ | ○ |
| Example 9 | G | a | ◎ | ◎ | ◎ | ◎ | ◎ | ◎ | ◎ | ◎ | ○ | ○ | ○ |
| Example 10 | H | a | ◎ | ◎ | ◎ | ◎ | ◎ | ◎ | ◎ | ◎ | ○ | ○ | ○ |
| Example 11 | I | a | ◎ | ◎ | ◎ | ◎ | ◎ | ◎ | ◎ | ◎ | ◎ | ◎ | ◎ |
| Comparative Example 1 | J | a | ◎ | ◎ | ◎ | ○ | ○ | ○ | ○ | ○ | ○ | Δ | Δ |
| Comparative Example 2 | K | a | ◎ | ◎ | ◎ | ◎ | ◎ | ○ | ○ | ○ | ○ | ○ | ○ |
| Comparative Example 3 | D | a | ◎ | ◎ | ○ | ○ | ○ | ○ | ○ | Δ | Δ | Δ | X |
| Comparative Example 4 | E | a | ◎ | ◎ | ◎ | ◎ | ◎ | ◎ | ○ | ○ | ○ | ○ | Δ |
| Comparative Example 5 | E | a | ◎ | ◎ | ◎ | ◎ | ◎ | ◎ | ○ | ○ | ○ | ○ | ○ |
| Comparative Example 6 | D | a | ◎ | ◎ | ◎ | ◎ | ◎ | ○ | ○ | ○ | ○ | ○ | Δ |
| Comparative Example 7 | K | a | ◎ | ◎ | ◎ | ◎ | ◎ | ○ | ○ | ○ | ○ | ○ | ○ |
| Comparative Example 8 | J | a | Δ | Δ | Δ | Δ | Δ | Δ | X | X | X | X | X |

(Experimental Example 2)

The same processes as those of Experimental Example 1 were carried out except that the respective developing agents were loaded in a copying machine Di-30 made by Minolta K.K. which was modified. Then, evaluation was made with respect to the above-mentioned evaluation items. The results of the evaluation are shown in Tables 6 through 8. Here, the copying machine used was Minolta Di-30 copying machine in which a toner-recycling system was installed, that is, a copying machine having a structure as shown in FIG. 2.

TABLE 6

(Evaluation: Fog)

| | | | B/W 10% | | | | B/W 50% | B/W 10% | | B/W 50% | B/W 10% | | B/W 50% |
|---|---|---|---|---|---|---|---|---|---|---|---|---|---|
| | Carrier | Toner | Initial | 10,000 sheets | 50,000 sheets | 100,000 sheets | 110,000 sheets | 150,000 sheets | 200,000 sheets | 210,000 sheets | 250,000 sheets | 300,000 sheets | 310,000 sheets |
| Example 1 | A | a | ◎ | ◎ | ◎ | ◎ | ◎ | ◎ | ◎ | ◎ | ◎ | ◎ | ○ |
| Example 2 | B | a | ◎ | ◎ | ◎ | ◎ | ◎ | ◎ | ◎ | ◎ | ○ | ○ | ○ |
| Example 3 | C | a | ◎ | ◎ | ◎ | ◎ | ◎ | ○ | ○ | ○ | ○ | ○ | ○ |
| Example 4 | D | a | ◎ | ◎ | ◎ | ◎ | ◎ | ◎ | ◎ | ◎ | ○ | ○ | ○ |
| Example 5 | E | a | ◎ | ◎ | ◎ | ◎ | ◎ | ◎ | ◎ | ◎ | ◎ | ○ | ○ |
| Example 6 | E | a | ◎ | ◎ | ◎ | ◎ | ○ | ○ | ○ | ○ | ○ | ○ | ○ |
| Example 7 | D | a | ◎ | ◎ | ◎ | ◎ | ◎ | ◎ | ◎ | ◎ | ◎ | ◎ | ○ |
| Example 8 | F | a | ◎ | ◎ | ◎ | ◎ | ◎ | ◎ | ○ | ○ | ○ | ○ | ○ |
| Example 9 | G | a | ◎ | ◎ | ◎ | ◎ | ◎ | ◎ | ◎ | ◎ | ◎ | ○ | ○ |
| Example 10 | H | a | ◎ | ◎ | ◎ | ◎ | ◎ | ◎ | ◎ | ◎ | ◎ | ○ | ○ |
| Example 11 | I | a | ◎ | ◎ | ◎ | ◎ | ◎ | ◎ | ◎ | ◎ | ○ | ○ | ○ |
| Comparative Example 1 | J | a | ◎ | ◎ | ◎ | ◎ | ○ | ○ | ○ | ○ | ○ | ○ | ○ |
| Comparative Example 2 | K | a | ◎ | ○ | ○ | ○ | Δ | Δ | Δ | Δ | Δ | Δ | X |
| Comparative Example 3 | D | a | ◎ | ◎ | ◎ | ◎ | ○ | ○ | ○ | ○ | ○ | ○ | ○ |
| Comparative Example 4 | E | a | ◎ | ◎ | ◎ | ◎ | ○ | ○ | ○ | ○ | ○ | ○ | ○ |
| Comparative Example 5 | E | a | ◎ | ○ | ○ | Δ | Δ | Δ | Δ | Δ | Δ | X | X |
| Comparative Example 6 | D | a | ◎ | ◎ | ◎ | ◎ | ○ | ○ | ○ | ○ | ○ | ○ | ○ |
| Comparative Example 7 | K | a | ○ | Δ | Δ | Δ | Δ | Δ | X | X | X | X | X |
| Comparative Example 8 | J | a | ○ | Δ | Δ | X | X | X | X | X | X | X | X |

TABLE 7

(Evaluation: Image density)

| | | | B/W 10% | | | | B/W 50% | B/W 10% | | B/W 50% | B/W 10% | | B/W 50% |
|---|---|---|---|---|---|---|---|---|---|---|---|---|---|
| | Carrier | Toner | Initial | 10,000 sheets | 50,000 sheets | 100,000 sheets | 110,000 sheets | 150,000 sheets | 200,000 sheets | 210,000 sheets | 250,000 sheets | 300,000 sheets | 310,000 sheets |
| Example 1 | A | a | ◎ | ◎ | ◎ | ◎ | ◎ | ◎ | ◎ | ◎ | ◎ | ◎ | ○ |
| Example 2 | B | a | ◎ | ◎ | ◎ | ◎ | ◎ | ◎ | ◎ | ◎ | ◎ | ◎ | ○ |
| Example 3 | C | a | ◎ | ◎ | ◎ | ◎ | ◎ | ◎ | ◎ | ◎ | ○ | ○ | ○ |
| Example 4 | D | a | ◎ | ◎ | ◎ | ◎ | ◎ | ◎ | ○ | ○ | ○ | ○ | ○ |
| Example 5 | E | a | ◎ | ◎ | ◎ | ◎ | ◎ | ○ | ○ | ○ | ○ | ○ | ○ |
| Example 6 | E | a | ◎ | ◎ | ◎ | ◎ | ◎ | ◎ | ◎ | ○ | ○ | ○ | ○ |
| Example 7 | D | a | ◎ | ◎ | ◎ | ◎ | ◎ | ○ | ○ | ○ | ○ | ○ | ○ |
| Example 8 | F | a | ◎ | ◎ | ◎ | ◎ | ◎ | ◎ | ◎ | ◎ | ◎ | ○ | ○ |
| Example 9 | G | a | ◎ | ◎ | ◎ | ◎ | ◎ | ◎ | ◎ | ◎ | ○ | ○ | ○ |
| Example 10 | H | a | ◎ | ◎ | ◎ | ◎ | ◎ | ◎ | ◎ | ◎ | ◎ | ○ | ○ |
| Example 11 | I | a | ◎ | ◎ | ◎ | ◎ | ◎ | ◎ | ◎ | ◎ | ◎ | ◎ | ○ |
| Comparative Example 1 | J | a | ◎ | ◎ | ◎ | ◎ | ○ | ○ | ○ | ○ | ○ | ○ | ○ |
| Comparative Example 2 | K | a | ◎ | ◎ | ◎ | ◎ | ◎ | ○ | ○ | ○ | ○ | ○ | ○ |
| Comparative Example 3 | D | a | ◎ | ◎ | ○ | ○ | ○ | ○ | ○ | Δ | Δ | Δ | Δ |
| Comparative Example 4 | E | a | ◎ | ◎ | ◎ | ○ | ○ | ○ | Δ | Δ | Δ | Δ | Δ |
| Comparative Example 5 | E | a | ◎ | ◎ | ◎ | ◎ | ○ | ○ | ○ | ○ | ○ | ○ | ○ |
| Comparative Example 6 | D | a | ◎ | ◎ | ◎ | ○ | ○ | ○ | ○ | ○ | Δ | Δ | X |
| Comparative Example 7 | K | a | ◎ | ○ | ○ | Δ | X | X | X | X | X | X | X |
| Comparative Example 8 | J | a | ○ | Δ | Δ | Δ | Δ | Δ | X | X | X | X | X |

TABLE 8

| | | | (Evaluation: Density unevenness) | | | | | | | | | | |
|---|---|---|---|---|---|---|---|---|---|---|---|---|---|
| | | | B/W 10% | | | | B/W 50% | B/W 10% | | B/W 50% | B/W 10% | | B/W 50% |
| | Carrier | Toner | Initial | 10,000 sheets | 50,000 sheets | 100,000 sheets | 110,000 sheets | 150,000 sheets | 200,000 sheets | 210,000 sheets | 250,000 sheets | 300,000 sheets | 310,000 sheets |
| Example 1 | A | a | ◎ | ◎ | ◎ | ◎ | ◎ | ◎ | ◎ | ◎ | ◎ | ◎ | ○ |
| Example 2 | B | a | ◎ | ◎ | ◎ | ◎ | ◎ | ◎ | ○ | ○ | ○ | ○ | ○ |
| Example 3 | C | a | ◎ | ◎ | ◎ | ◎ | ◎ | ◎ | ◎ | ◎ | ◎ | ○ | ○ |
| Example 4 | D | a | ◎ | ◎ | ◎ | ◎ | ◎ | ◎ | ○ | ○ | ○ | ○ | ○ |
| Example 5 | E | a | ◎ | ◎ | ◎ | ◎ | ◎ | ◎ | ◎ | ◎ | ○ | ○ | ○ |
| Example 6 | E | a | ◎ | ◎ | ◎ | ◎ | ◎ | ◎ | ◎ | ◎ | ◎ | ○ | ○ |
| Example 7 | D | a | ◎ | ◎ | ◎ | ◎ | ◎ | ◎ | ◎ | ◎ | ○ | ○ | ○ |
| Example 8 | F | a | ◎ | ◎ | ◎ | ◎ | ◎ | ◎ | ◎ | ◎ | ◎ | ○ | ○ |
| Example 9 | G | a | ◎ | ◎ | ◎ | ◎ | ◎ | ◎ | ○ | ○ | ○ | ○ | ○ |
| Example 10 | H | a | ◎ | ◎ | ◎ | ◎ | ◎ | ◎ | ○ | ○ | ○ | ○ | ○ |
| Example 11 | I | a | ◎ | ◎ | ◎ | ◎ | ◎ | ◎ | ◎ | ◎ | ◎ | ◎ | ○ |
| Comparative Example 1 | J | a | ◎ | ○ | ○ | ○ | ○ | ○ | Δ | Δ | Δ | X | X |
| Comparative Example 2 | K | a | ◎ | ◎ | ◎ | ○ | ○ | ○ | ○ | ○ | ○ | ○ | ○ |
| Comparative Example 3 | D | a | ◎ | ○ | ○ | ○ | ○ | Δ | Δ | Δ | X | X | X |
| Comparative Example 4 | E | a | ◎ | ◎ | ◎ | ◎ | ◎ | ○ | ○ | ○ | ○ | ○ | Δ |
| Comparative Example 5 | E | a | ◎ | ◎ | ◎ | ◎ | ◎ | ○ | ○ | ○ | ○ | ○ | ○ |
| Comparative Example 6 | D | a | ◎ | ◎ | ◎ | ○ | ○ | ○ | ○ | ○ | ○ | Δ | Δ |
| Comparative Example 7 | K | a | ◎ | ◎ | ◎ | ○ | ○ | ○ | ○ | ○ | ○ | ○ | ○ |
| Comparative Example 8 | J | a | Δ | Δ | X | X | X | X | X | X | X | X | X |

In the present invention, it is possible to prevent the occurrence of fog and image irregularity as well as reduction in the image density for a long time. Moreover, even in the case of the adoption of a toner recycling system, it is possible to prevent the occurrence of fog and image irregularity as well as reduction in the image density for a long time.

What is claimed is:

1. A two-component developing agent comprising:

a toner; and a carrier having a bulk specific density ($AD_1$) of 1.07 to 1.43 g/cc, wherein said developing agent has a bulk specific density ($AD_2$) of 0.83 to 1.16 g/cc and $AD_2/AD_1$ is in a range of 0.69 to 0.91.

2. The two-component developing agent according to claim 1, wherein said carrier has a bulk specific density of 1.10 to 1.40 g/cc.

3. The two-component developing agent according to claim 2, wherein said carrier has a bulk specific density of 1.15 to 1.35 g/cc.

4. The two-component developing agent according to claim 1, wherein said developing agent has a bulk specific density of 0.85 to 1.15 g/cc.

5. The two-component developing agent according to claim 4, wherein said developing agent has a bulk specific density of 0.90 to 1.10 g/cc.

6. The two-component developing agent according to claim 1, wherein said $AD_2/AD_1$ is in a range of 0.70 to 0.90.

7. The two-component developing agent according to claim 6, wherein said $AD_2/AD_1$ is in a range of 0.75 to 0.85.

8. The two-component developing agent according to claim 1, wherein said carrier comprises magnetic particles dispersed in a binder resin.

9. The two-component developing agent according to claim 1, wherein said carrier has a shape factor (SFc) of 1.08 to 2.37, said shape factor being represented by:

$$SFc=L^2/4\pi S$$

wherein L represents a peripheral length of projection image of said carrier and S represents an area of projection image of said carrier.

10. The two-component developing agent according to claim 9, wherein said toner has a shape factor (SFt) of 1.1 to 2.5, said shape factor being represented by:

$$SFt=L^2/4\pi S$$

wherein L represents a peripheral length of projection image of said toner and S represents an area of projection image of said toner.

11. The two-component developing agent according to claim 10, wherein said carrier has a shape factor of 1.20 to 2.09 and said toner has a shape factor of 1.2 to 2.0.

12. The two-component developing agent according to claim 11, wherein a product SFc×SFt of the shape factor (SFc) of carrier and the shape factor (SFt) of toner is in a range of 1.50 to 3.55.

13. The two-component developing agent according to claim 12, wherein said SFc×SFt is in a range of 1.50 to 3.50.

14. The two-component developing agent according to claim 1, wherein said carrier has a volume-average particle size of 20 to 50 $\mu$m.

15. The two-component developing agent according to claim 1, wherein said toner is contained at a content of 3 to 20% by weight with respect to said developing agent.

16. An image-forming method comprising the steps of:

supplying a two-component developing agent to a developer-supporting member that is placed face to face with image-supporting member, said two-component developing agent comprising a toner and a carrier having a bulk specific density ($AD_1$) of 1.07 to 1.43 g/cc and having a bulk specific density ($AD_2$) of 0.83 to 1.16 g/cc and $AD_2/AD_1$ of 0.69 to 0.91;

transporting a predetermined amount of the developing agent to a developing area by regulating the two-component developing agent on the developer-supporting member by a regulating member; and developing an electrostatic latent image by the toner under application of a developing bias voltage at the developing area.

17. The method according to claim 16, wherein the amount of the developing agent to be transported to the developing area is set at 0.7 to 10 mg/cm$^2$.

18. The method according to claim 16, wherein said carrier has a bulk specific density of 1.10 to 1.40 g/cc, said developing agent has a bulk specific density of 0.85 to 1.15 g/cc and said $AD_2/AD_1$ is in a range of 0.70 to 0.90.

19. An image-forming system comprising:

an image-supporting member having a surface for supporting an electrostatic latent image;

a developing machine housing a two-component developing agent, said two-component developing agent comprising a toner and a carrier having a bulk specific density ($AD_1$) of 1.07 to 1.43 g/cc and having a bulk specific density ($AD_2$) of 0.83 to 1.16 g/cc and $AD_2/AD_1$ of 0.69 to 0.91;

a cleaning device for recovering residual developing agent on the image-supporting member; and a transporting device for transporting the developing agent recovered by the cleaning device to the developing machine.

20. The system according to claim 19, wherein said carrier has a bulk specific density of 1.10 to 1.40 g/cc, said developing agent has a bulk specific density of 0.85 to 1.15 g/cc and said $AD_2/AD_1$ is in a range of 0.70 to 0.90.

* * * * *